US008721751B2

(12) United States Patent
Querel et al.

(10) Patent No.: US 8,721,751 B2
(45) Date of Patent: May 13, 2014

(54) BONDED ABRASIVE ARTICLE AND METHOD OF FORMING

(75) Inventors: Gilles Querel, Compiegne (FR); Sandhya Jayaraman Rukmani, Worcester, MA (US); Muthu Jeevanantham, Worcester, MA (US); Kelley McNeal, Marlborough, MA (US); Maike Hillers, Paris (FR)

(73) Assignees: Saint-Gobain Abrasives, Inc., Worcester, MA (US); Saint-Gobain Abrasifs, Conflans-Sainte-Honorine (FR)

( * ) Notice: Subject to any disclaimer, the term of this patent is extended or adjusted under 35 U.S.C. 154(b) by 1188 days.

(21) Appl. No.: 12/959,282

(22) Filed: Dec. 2, 2010

(65) Prior Publication Data

US 2011/0131889 A1 Jun. 9, 2011

Related U.S. Application Data

(60) Provisional application No. 61/266,043, filed on Dec. 2, 2009.

(51) Int. Cl.

| | |
|---|---|
| ***B24D 3/06*** | (2006.01) |
| ***C03C 3/091*** | (2006.01) |
| ***C03C 3/089*** | (2006.01) |

(52) U.S. Cl.
USPC ..... 51/293; 501/66

(58) Field of Classification Search
USPC ..... 51/293, 307–309; 501/66, 77
See application file for complete search history.

(56) References Cited

U.S. PATENT DOCUMENTS

| | | | | |
|---|---|---|---|---|
| 4,314,827 | A | 2/1982 | Leitheiser et al. | |
| 4,543,107 | A | 9/1985 | Rue | |
| 4,623,364 | A | 11/1986 | Cottringer et al. | |
| 4,898,597 | A | 2/1990 | Hay et al. | |
| 4,944,773 | A | 7/1990 | Rue et al. | |
| 4,997,461 | A | 3/1991 | Markhoff-Matheny et al. | |
| 5,037,452 | A * | 8/1991 | Gary et al. | 51/293 |
| 5,090,970 | A | 2/1992 | Rue et al. | |
| 5,131,923 | A * | 7/1992 | Markhoff-Matheny et al. | 51/293 |
| 5,203,886 | A | 4/1993 | Sheldon et al. | |
| 5,244,477 | A | 9/1993 | Rue et al. | |
| 5,401,284 | A | 3/1995 | Sheldon et al. | |
| 5,536,283 | A | 7/1996 | Sheldon et al. | |
| 5,672,185 | A | 9/1997 | Ryoke | |
| 5,863,308 | A * | 1/1999 | Qi et al. | 51/309 |
| 5,975,988 | A | 11/1999 | Christianson | |
| 6,066,189 | A | 5/2000 | Meyer et al. | |
| 6,086,648 | A * | 7/2000 | Rossetti et al. | 51/304 |
| 6,287,353 | B1 | 9/2001 | Celikkaya | |
| 6,500,220 | B1 * | 12/2002 | Krueger et al. | 51/306 |
| 6,592,640 | B1 | 7/2003 | Rosenflanz et al. | |
| 6,702,867 | B2 * | 3/2004 | Carman et al. | 51/307 |
| 2003/0045221 | A1 | 3/2003 | Li et al. | |
| 2003/0194947 | A1 * | 10/2003 | Bright et al. | 451/28 |
| 2003/0236062 | A1 | 12/2003 | Li et al. | |
| 2005/0183407 | A1 | 8/2005 | Hayward et al. | |
| 2006/0196123 | A1 | 9/2006 | Marlin | |
| 2008/0222967 | A1 | 9/2008 | Querel et al. | |
| 2011/0083374 | A1 | 4/2011 | Querel et al. | |
| 2011/0131888 | A1 | 6/2011 | Querel et al. | |
| 2011/0131889 | A1 | 6/2011 | Querel et al. | |

FOREIGN PATENT DOCUMENTS

| | | | |
|---|---|---|---|
| CN | 1420100 | A | 5/2003 |
| CN | 1509843 | A | 7/2004 |
| DE | 3346772 | A1 | 9/1985 |
| EP | 0152768 | A2 | 8/1985 |
| JP | S49-4285 | A | 1/1974 |
| JP | 60151247 | A | 8/1985 |
| JP | H03-205475 | A | 9/1991 |
| JP | H05-163060 | A | 6/1993 |
| JP | H06-86326 | B2 | 11/1994 |
| JP | H06-335866 | A | 12/1994 |
| JP | H07-16882 | B2 | 3/1995 |
| JP | H08-39434 | A | 2/1996 |
| JP | H08-505175 | A | 6/1996 |
| JP | 2001-260032 | A | 9/2001 |
| JP | 2003-521577 | A | 7/2003 |
| JP | 2006-247837 | A | 9/2006 |
| JP | 2007-231287 | A | 9/2007 |
| JP | 2000-280175 | A | 10/2010 |
| JP | 2013-507260 | A | 3/2013 |
| JP | 2013-512114 | A | 4/2013 |
| JP | 2013-512115 | A | 4/2013 |
| SU | 361158 | A1 | 12/1972 |
| SU | 1177326 | A1 | 9/1985 |
| WO | 94/14722 | A1 | 7/1994 |
| WO | 0035632 | A2 | 6/2000 |
| WO | 01/14495 | A1 | 3/2001 |
| WO | 2008079680 | A1 | 3/2008 |

OTHER PUBLICATIONS

PCT Application No. PCT/US2010/058783, Filed Dec. 2, 2010 "Notification of Transmittal of the International Search Report and The Written Opinion of the International Searching Authority, or the Declaration", dated Aug. 19, 2011, 10 pages.

PCT Application No. PCT/US2010/052051, Filed Oct. 8, 2010 "Notification of Transmittal of the International Search Report and The Written Opinion of the International Searching Authority, or the Declaration", dated Jun. 3, 2011, 10 pages.

PCT Application No. PCT/US2010/058782, Filed Dec. 2, 2010 "Notification of Transmittal of the International Search Report and The Written Opinion of the International Searching Authority, or the Declaration", dated Aug. 17, 2011, 10 pages.

U.S. Appl. No. 12/959,273, filed Dec. 2, 2010, Inventors: Gilles Querel et al.

U.S. Appl. No. 12/901,218, filed Oct. 8, 2009, Inventors: Gilles Querel et al.

* cited by examiner

*Primary Examiner* — Pegah Parvini

(74) *Attorney, Agent, or Firm* — Abel Law Group, LLP; Joseph P. Sullivan

(57) ABSTRACT

An abrasive article including an abrasive body having abrasive grains made of microcrystalline alumina contained within a bond material, wherein the bond material comprises a total content of alumina of at least about 15 mol %.

20 Claims, 2 Drawing Sheets

BONDED ABRASIVE ARTICLE AND METHOD OF FORMING

CROSS-REFERENCE TO RELATED APPLICATION(S)

The present application claims priority from U.S. Provisional Patent Application No. 61/266,043, filed Dec. 2, 2009, entitled "BONDED ABRASIVE ARTICLE AND METHOD OF FORMING," naming inventors Gilles Querel, Sandhya Jayaraman Rukmani, Muthu Jeevanantham, Kelley McNeal, and Maike Hillers, which application is incorporated by reference herein in its entirety.

BACKGROUND

1. Field of the Disclosure

The following is directed to bonded abrasives and particularly bonded abrasive articles incorporating microcrystalline alumina abrasive grains.

2. Description of the Related Art

Abrasive tools are generally formed to have abrasive grains contained within a bond material for material removal applications. Superabrasive grains (e.g., diamond or cubic boron nitride (CBN)) or seeded (or even unseeded) sintered sol gel alumina abrasive grain, also referred to microcrystalline alpha-alumina (MCA) abrasive grain, can be employed in such abrasive tools and are known to provide superior grinding performance on a variety of materials. The bond material can be organic materials, such as a resin, or an inorganic material, such as a glass or vitrified material. In particular, bonded abrasive tools using a vitrified bond material and containing MCA grains or superabrasive grain are commercially useful for grinding precision metal parts and other industrial components requiring consistent and improved grinding performance.

Certain bonded abrasive tools, particularly those utilizing a vitrified bond material, require high temperature forming processes, which can have deleterious effects on the abrasive grains. In fact, it has been recognized that at such elevated temperatures necessary to form the abrasive tool, the bond material can react with the abrasive grains, particularly MCA grains, damaging the integrity of the abrasive, and reducing the grain sharpness and performance properties. As a result, the industry has migrated toward reducing the formation temperatures necessary to form the bond material in order to curb the high temperature degradation of the abrasive grains during the forming process.

For example, to reduce the amount of reaction between MCA grain and vitrified bond, U.S. Pat. No. 4,543,107 discloses a bond composition suitable for firing at a temperature as low as about 900° C. In an alternate approach, U.S. Pat. No. 4,898,597 discloses a bond composition comprising at least 40% fritted materials suitable for low firing temperature vitreous bonds. Other such bonded abrasive articles utilizing bond materials capable of forming at temperatures below 1100° C., and in fact, below 1000° C., include U.S. Pat. No. 5,203,886, U.S. Pat. No. 5,401,284, U.S. Pat. No. 5,536,283, and U.S. Pat. No. 6,702,867. Still, the industry continues to demand improved performance of such bonded abrasive articles.

SUMMARY

According to one aspect, an abrasive article includes an abrasive body having abrasive grains comprising microcrystalline alumina contained within a bond material, wherein the bond material has a total content of alumina of at least about 15 mol %.

According to another aspect, an abrasive article includes an abrasive body having abrasive grains made of microcrystalline alumina contained within a vitreous bond material, wherein the vitreous bond material comprises a total content of alumina $[C_{Al2O3}]$ in mol % of at least about 15 mol %. The vitreous bond material further comprises a total content of silica $[C_{SiO2}]$ in mol %, the vitreous bond material having a ratio of $[C_{Al2O3}]/[C_{SiO2}]$ of at least about 0.2.

In another aspect an abrasive article includes an abrasive body having abrasive grains made of microcrystalline alumina contained within a vitreous bond material, wherein the vitreous bond material comprises a total content of alumina $[C_{Al2O3}]$ of at least about 15 mol %, a total content of silica $[C_{SiO2}]$ of not greater than about 70 mol %, and a total content of alkali oxide compounds $[C_{aoc}]$ selected from the group of alkali compounds consisting of potassium oxide ($K_2O$), sodium oxide ($Na_2O$), and lithium oxide ($Li_2O$) is not greater than about 15 mol %.

According to still another aspect, an abrasive article includes an abrasive body having abrasive grains comprising microcrystalline alumina contained within a vitreous bond material, wherein the vitreous bond material comprises a grain dissolution factor of not greater than about 1.0 wt %.

In yet another aspect, an abrasive article includes an abrasive body having abrasive grains comprising microcrystalline alumina contained within a vitreous bond material, wherein the vitreous bond material is formed from a powder bond material having a sufficient amount of alumina to reduce the dissolution of the abrasive grains as measured by a change in total alumina content $[\Delta Al_2O_3]$ between the alumina content of the powder bond material $[PBM_{Al2O3}]$ and the total alumina content of the vitreous bond material $[VBM_{Al2O3}]$ of not greater than about 15.0 mol % as calculated by the equation $$[\Delta Al_2O_3]=([VBM_{Al2O3}-PBM_{Al2O3}]/[PBM_{Al2O3}].$$

According to one aspect, a method of forming an abrasive article includes mixing abrasive grains comprising microcrystalline alumina with a bond material powder, wherein the bond material powder comprises at least about 15 mol % alumina, and forming the mixture into a green article. The method further includes heating the green article to a firing temperature of at least about 800° C. to form an abrasive article having abrasive grains contained within a vitreous bond material.

BRIEF DESCRIPTION OF THE DRAWINGS

The present disclosure may be better understood, and its numerous features and advantages made apparent to those skilled in the art by referencing the accompanying drawings.

The use of the same reference symbols in different drawings indicates similar or identical items.

DETAILED DESCRIPTION

The following is generally directed to an abrasive article, particularly a bonded abrasive article utilizing abrasive grains contained within a bond material. Such abrasive articles are useful in material removal applications, such as those in various industries for finishing and/or grinding workpieces. The abrasive articles can be shaped and sized to make various finishing tools, such as wheels, cones, cup-shaped articles, hones, and/or stones.

Figure 1:
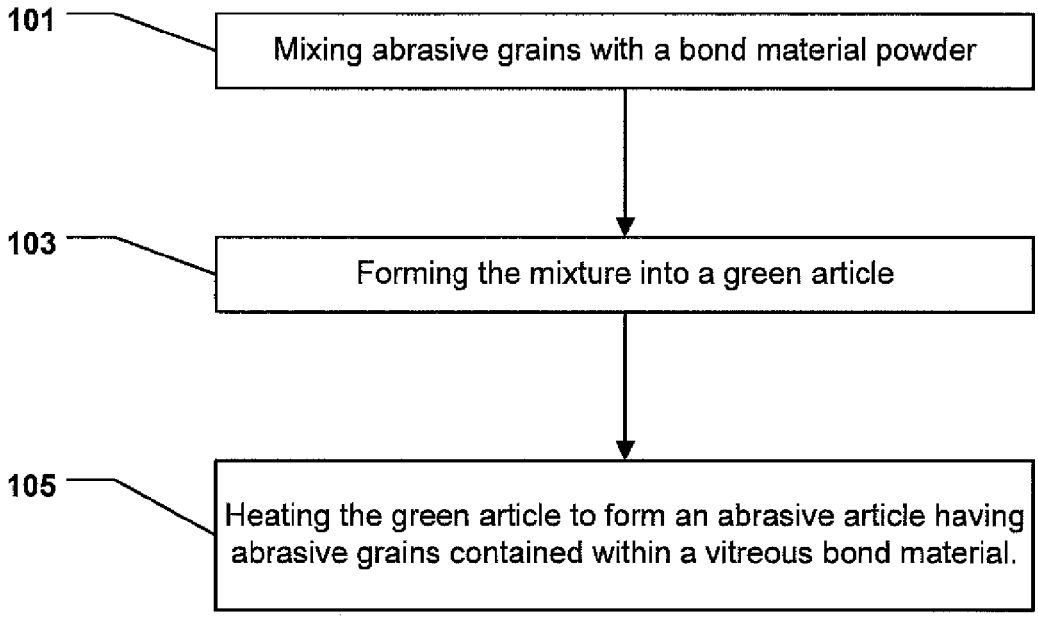
FIG. 1 includes a flow chart illustrating a method of forming an abrasive article in accordance with an embodiment.

FIG. 1 includes a flow chart illustrating a method of forming an abrasive article in accordance with an embodiment. As illustrated, the process is initiated at step 101 by mixing abrasive grains with a bond material powder. In accordance with an embodiment, the abrasive grains can include an inorganic material, such as an oxide. More particularly, the abrasive grains can include microcrystalline alumina (MCA) grains.

The MCA or sol-gel alumina grains are preferably produced by either a seeded or an unseeded sol-gel process. As used herein, the term "sol-gel alumina grits" are alumina grits made by a process comprising peptizing a sol of an aluminum oxide monohydrate so as to form a gel, drying and firing the gel to sinter it, and then breaking, screening, and sizing the sintered gel to form polycrystalline grains made of alpha alumina microcrystals (e.g., at least about 95% alumina). In addition to the alpha alumina microcrystals, the initial sol may further include up to 15% by weight of spinel, mullite, manganese dioxide, titania, magnesia, rare earth metal oxides, zirconia powder or a zirconia precursor (which can be added in larger amounts, e.g. 40 wt % or more), or other compatible additives or precursors thereof. These additives are often included to modify such properties as fracture toughness, hardness, friability, fracture mechanics, or drying behavior. Preparation of sintered sol gel alpha-alumina grains is described in detail elsewhere. Details of such preparations may be found, for example, in U.S. Pat. Nos. 4,623,364, 4,314,827, and 5,863,308, the contents of which are hereby incorporated by reference.

The term MCA grain is defined to include any grain comprising at least 60% alpha alumina microcrystals having at least 95% theoretical density and a Vickers hardness (500 grams) of at least 18 GPa at 500 grams. The sintered sol gel alpha-alumina grain may contain platelets of material other than alpha-alumina dispersed among the alpha-alumina microcrystals. Generally, the alpha-alumina particles and the platelets are submicron in size when made in this form. Further details of MCA abrasive grain preparations and MCA abrasive grain types useful in the present invention may be found in any one of the numerous other patents and publications, which cite the basic technology disclosed in the U.S. Pat. Nos. 4,623,364 and 4,314,827.

The microcrystalline alumina utilized in the abrasive grains can have an average crystallite size of less than 1 micron. In fact, in certain instances, the microcrystalline alumina can have an average crystallite size of less than about 0.5 microns, and particularly within a range between about 0.1 and about 0.2 microns.

Additionally, it will be appreciated that the bonded abrasive articles of embodiments herein may utilize a certain content of secondary abrasive grains. When secondary abrasive grains are used, such abrasive grains can provide from about 0.1 to about 97 vol % of the total abrasive grain of the tool, and more preferably, from about 30 to about 70 vol %. The secondary abrasive grains which may be used include, but are not limited to, alumina oxide, silicon carbide, cubic boron nitride, diamond, flint and garnet grains, and combinations thereof. As such, certain abrasive articles herein may utilize a mixture of abrasive grains such that the abrasive article comprises a first portion of abrasive grains made of MCA and a second portion of abrasive grains selected from the group of materials consisting of superabrasive grains, monocrystalline alumina, and a combination thereof.

In reference to the bond material powder, inorganic materials may be utilized, and in particular, inorganic materials that facilitate the formation of a final-formed abrasive article having a vitreous bond. That is, the final-formed bonded abrasive article can have a vitreous bond having a certain content of amorphous phase. In particular, the final-formed bonded abrasive article of embodiments herein can have a bond material that consists essentially of an amorphous phase.

In particular instances, the bond material powder can include inorganic materials, such as oxides. Notably, the bond material powder can include a frit material that is suitable for forming the final-formed vitreous bond material. A frit material can include a powder material formed form a glass, which is formed by firing initially to an elevated temperature (e.g., 1000° C. or greater), cooling, crushing and sizing to yield a powdered material ("a frit"). The frit then may be melted at a temperature well below the initial firing temperature used to make the glass from the raw materials, such as silica and clays.

The following paragraphs denote certain contents and certain compositions, which may be used in the bond material powder, otherwise the initial mixture of bond components. It will be appreciated that reference herein to the particular amounts of certain compositions in forming the mixture may not necessarily form a final vitreous bond material in the abrasive article having the exact same composition of the initial bond material powder. Particularly, the amount of certain oxide compounds present in the final vitreous bond material may be different than the amount of the same oxide compound present within the initial bond material powder, while the amount of other oxide components may remain substantially unchanged.

Embodiments herein can utilize a bond material powder having a frit material. The frit material may be formed from oxides such as silica, alkaline oxide compounds, alkaline earth oxide compounds, and a combination thereof. The frit material facilitates suitable forming of a vitrified bond material in the final-formed bonded abrasive. The frit material can be provided in an amount of up to 100% of the bond material powder, such that the bond material powder is comprised only of frit material, however, in particular instances the bond material powder can contain between about 10 wt % and about 60 wt % of frit material for the total weight of the bond material powder.

According to one embodiment, the bond material powder can include a certain content of silica ($SiO_2$). For example, embodiments herein may utilize a bond material powder formed from at least about 35 mol % silica. In other embodiments, the amount of silica can be greater, such as at least about 40 mol %, such as at least about 45 mol %, and particularly within a range between about 35 mol % and about 60 mol % silica, such as between about 40 mol % and about 55 mol %.

The frit material may also contain a particular content of materials, including for example, aluminum oxide (i.e., alumina). Provision of a frit material having a particular content of alumina may facilitate formation of a first liquid phase during the thermal treatment that is enriched with alumina, which may limit dissolution of the abrasive grains by the first liquid phase. Particularly suitable contents of alumina within the frit material can include at least about 20 mol %, such as at least about 25 mol %, at least about 30 mol %, at least about 40 mol %, or even at least about 50 mol % of the total moles of frit material. Still, the total amount of alumina may be limited, for example, within a range between about 20 mol % and about 75 mol %, such as between about 20 mol % and about 65 mol %, or even between about 20 mol % and about 50 mol %.

Additionally, the final-formed bond material can be formed from a bond material powder having a certain content of alkali oxide compounds. Alkali oxide compounds are oxide compounds and/or complexes utilizing alkali species denoted as Group 1A elements in the Periodic Table, such as lithium oxide ($Li_2O$), potassium oxide ($K_2O$), sodium oxide ($Na_2O$), cesium oxide ($Cs_2O$), and a combination thereof.

In accordance with one embodiment, the bond material powder can be formed from not greater than about 18 mol % total alkali oxide compounds. In other instances, the bond material powder is formed from less alkali oxide compounds, such as on the order of not greater than about 16 mol %, not greater than about 15 mol %, not greater than about 12 mol %, not greater than about 10 mol %, or even not greater than about 8.0 mol % of the total moles of the bond material powder. Particular embodiments herein may form a bond material powder having a total content of alkali oxide compounds within a range between about 2.0 mol % and about 18 mol %, such as between about 5.0 mol % and about 16 mol %, between about 8.0 mol % and about 15 mol %, and even between about 8.0 mol % and about 12 mol %.

The bond material powder can contain a particularly low content of lithium oxide, which may be more prevalent in certain low-temperature bond compositions. For example, in certain embodiments, the bond material powder can be formed from less than 8.0 mol % lithium oxide, such as less than about 6.0 mol % lithium oxide, less than about 5.0 mol % lithium oxide, and even less than about 4.0 mol % lithium oxide of the total moles of the bond material powder. Particular embodiments may utilize an amount of lithium oxide within a range between about 1.0 mol % and about 8.0 mol %, such as between about 2.0 mol % and about 6.0 mol %, or even between about 3.0 mol % and about 6.0 mol %.

The bond material powder can be formed from a particular content of potassium oxide, which can be less than a content of any other alkali oxide material as measured in mol %. In fact, certain bond material powder compositions may contain an amount of potassium oxide of not greater than about 6.0 mol %, such as on the order of not greater than about 5.0 mol %, not greater than about 4.0 mol %, or even not greater than about 3.0 mol % of the total moles of the bond material powder. Still, the bond material powder can be formed from an amount of potassium oxide within a range between about 0.01 mol % and about 6.0 mol %, such as between about 0.1 mol % and about 5.0 mol %, and even between about 0.2 mol % and about 5.0 mol %.

The bond material powder can be formed from a particular content of sodium oxide. Notably, the content of sodium oxide may be greater than the amount of any other individual alkali oxide compound, such as potassium oxide or lithium oxide. In certain bond material powder compositions, the amount of sodium oxide is at least 2 times greater than the amount of potassium oxide or lithium oxide. Other bond material powder compositions can have at least about 3 times greater sodium oxide, at least 4 times greater, and particularly between about 2 times greater and about 5 time greater amount of sodium oxide than potassium oxide or lithium oxide.

For certain embodiments, the bond material powder can be formed from at least about 6.0 mol % sodium oxide of the total moles of the bond material powder. In other instances, the bond material powder can be formed from at least about 8.0 mol %, at least about 10 mol %, at least about 12 mol %, or eve at least about 14 mol % sodium oxide. Certain bond material powders contain an amount of sodium oxide within a range between about 6.0 mol % and about 18 mol %, such as between about 8.0 mol % and about 16 mol %, such as between about 10 mol % and about 15 mol %.

The final vitreous bond material can be formed from a bond material powder, which can be formed from a certain content of alkaline earth oxide compounds. Alkaline earth oxide compounds are oxide compounds and complexes incorporating divalent species from the alkaline earth elements present in Group 2A of the Periodic Table of Elements. That is, for example, suitable alkaline earth oxide compounds can include magnesium oxide (MgO), calcium oxide (CaO), strontium oxide (SrO), barium oxide (BaO), and a combination thereof.

In accordance with one embodiment, the bond material powder used can be formed from not greater than about 15 mol % total alkaline earth oxide compounds of the total moles of the bond material powder. In other instances, the content of alkaline earth oxide compounds is less, such as on the order of not greater than about 12 mol %, not greater than about 10 mol %, not greater than about 8.0 mol %, not greater than about 6.0 mol %, not greater than about 5.0 mol %, or even not greater than about 4.0 mol %. Particular embodiments herein may utilize a total content of alkaline earth oxide compounds within a range between about 0.05 mol % and about 15 mol %, such as between about 0.1 mol % and about 12 mol %, between about 0.1 mol % and about 10 mol %, between about 0.1 mol % and about 8.0 mol %, and even between about 0.5 mol % and about 5.0 mol %.

Of the alkaline earth oxide compounds, magnesium oxide may be present in the greatest content as compared to the other alkaline earth oxide compounds for certain bond material powder compositions. For example, a sufficient amount of magnesium oxide within the bond material powder can include at least about 0.5 mol %, such as at least 1.0 mol %, at least about 1.5 mol % magnesium oxide, and particularly between about 0.5 mol % and about 5.0 mol %, or between about 0.5 mol % and about 3.0 mol % of the total moles of the bond material powder. Still, certain bond material powder compositions can be essentially free of magnesium oxide.

The bond material powder can include a certain content of calcium oxide. In particular, the content of calcium oxide can be less than the content of magnesium oxide, but this may not necessarily be the case for all bond material powder compositions. For example, embodiments herein may utilize a bond material powder formed from not greater than about 5.0 mol %, such as not greater than about 3.0 mol %, not greater than about 2.0 mol %, or even not greater than about 1.0 mol % calcium oxide of the total moles of the bond material powder. Particular mixes of the bond material powder can be formed from between about 0.01 mol % and about 5.0 mol %, such as between about 0.05 mol % and about 3.0 mol %, and even between about 0.05 mol % and about 1.0 mol % calcium oxide. In some cases, the bond material powder can be essentially free of calcium oxide.

The amount of barium oxide within the bond material powder can be limited, and particularly less than the content of magnesium oxide and/or calcium oxide. For example, embodiments herein may utilize a bond material powder formed from not greater than about 5.0 mol % barium oxide, such as not greater than about 3.0 mol %, not greater than about 2.0 mol %, or even not greater than about 1.0 mol % barium oxide of the total moles of the bond material powder. Notably, the bond material powder can be formed from between about 0.01 mol % and about 5.0 mol %, such as between about 0.05 mol % and about 3.0 mol %, and even between about 0.05 mol % and about 1.0 mol % barium oxide. In some cases, the bond material powder can be essentially free of barium oxide.

According to embodiments herein, the final vitreous bond material can be formed from a bond material powder, which can be formed to have a particular content of alumina ($Al_2O_3$). Notably, the bond material powder can be formed from particularly high contents of alumina to saturate the bond material during formation and reduce thermodynamic potential of grain dissolution by the bond material. For example, embodiments herein may utilize a bond material powder formed from an amount of alumina of at least about 14 mol %, such as at least about 14.5 mol %, at least about 15 mol %, at least about 15.5 mol %, at least about 16 mol %, at least about 16.5 mol %, at least about 17 mol %, at least about 18 mol %, at least about 19 mol %, or even at least about 20 mol %. Still, the content of alumina may be limited, such that the bond material powder composition contains between about 14 mol % and about 30 mol %, between about 14 mol % and about 25 mol %, between about 14 mol % and about 23 mol %, between about 14 mol % and about 20 mol %, between about 14 mol % and about 19 mol %, between about 14 mol % and about 18 mol %, between about 15 mol % and about 18 mol %, or even between about 16 mol % and about 18 mol % alumina.

In addition to the oxide species noted above, the final vitreous bond may be formed from a bond material powder having a particular content of phosphorous oxide ($P_2O_5$), which may be a particularly small amount compared to certain low-temperature bond compositions. For example, the bond material powder can be formed from less than 1.0 mol % phosphorous oxide. In other embodiments, the bond material powder can be formed from less than about 0.5 mol % phosphorous oxide. In particular instances, the bond material powder can be formed such that it is essentially free of phosphorous oxide.

Additionally, the bond material powder can be formed from particular contents of boron oxide ($B_2O_3$). For example, the bond material powder may be formed from at least about 5.0 mol %, at least about 8.0 mol %, at least about 10 mol %, at least about 12 mol %, or even at least about 15 mol % boron oxide. In certain instances, the bond material powder can be formed from between about 5.0 mol % and about 25 mol %, such as between about 5.0 mol % and 20 mol %, between about 10 mol % and about 20 mol %, or even between about 12 mol % and about 18 mol % boron oxide.

In addition to certain species noted above, additional metal oxide compounds can be added to the mixture to facilitate the formation of the final vitreous bond material. Some suitable additional compounds can include oxides of transition metal elements, including for example, but not limited to, zinc oxide, iron oxide, manganese oxide, titanium oxide, chromium oxide, zirconium oxide, bismuth oxide and a combination thereof. Each of the additional metal oxide compounds may be present in minor amounts, such as not greater than about 5.0 mol %, not greater than about 3.0 mol %, or even not greater than about 1.0 mol %.

After making a mixture of abrasive grains and bond material powder, it will be appreciated, that other materials may be added to the mixture. For example, certain organic compounds may be added to the mixture such as binders and the like to facilitate formation of the article. In accordance with one particular embodiment, the mixture can contain a certain content of polyethylene glycol, animal glue, dextrin, maleic acid, latex, wax emulsion, PVA, CMC, and other organic and/or inorganic binder.

Additionally, other additives may be provided within the mixture to facilitate formation of the final-formed bonded abrasive article. For example, some suitable additives can include pore formers including, but not limited to, hollow glass beads, ground walnut shells, beads of plastic material or organic compounds, foamed glass particles and bubble alumina, elongated grains, fibers and combinations thereof. Other types of filler materials can include inorganic materials, such as pigments and/or dyes which can provide color to final formed abrasive article.

After forming the mixture at step 101, the process can continue at step 103 by forming the mixture to form a green article. A green article is reference to an unfinished article, which may not be thoroughly heat treated to complete densification (i.e. fully sintered). In accordance with one embodiment, the process of forming the mixture can include a pressing operation wherein the mixture is pressed into a particular shape similar to the shape of the intended final-formed bonded abrasive article. A pressing operation may be conducted as a cold pressing operation. Suitable pressures can be within a range between about 10 and about 300 tons.

After suitably forming the mixture at step 103, the process can continue at step 105 by heating the green article to form an abrasive article having abrasive grains contained within a vitreous bond material. The process of heating the green article can include heating the green article in a furnace to a firing temperature of at least 800° C. to form the abrasive article. Firing is generally carried out at a temperature suitable to form a vitrified bond material as measured by the set point of the furnace. The forming processes of the embodiments herein may utilize notably high firing temperatures, such as at least about 825° C., at least about 850° C., at least about 875° C., at least about 900° C., at least about 910° C., at least about 950° C., at least about, at least about 1000° C., at least about 1050° C., at least about 1100° C., at least about 1150° C., at least 1200° C., at least about 1250° C., or even at least about 1300° C. The firing temperature used to form the bonded abrasive articles of embodiments herein can be within a range between about 800° C. and about 1400° C., such as within a range between about 800° C. and about 1300° C., such as within a range between about 900° C. and about 1400° C., such as within a range between about 900° C. and about 1300° C. or even within a range between 1100° C. and about 1400° C.

Generally, firing can be carried out in an ambient atmosphere, such that it contains air. Generally, the duration of peak temperature for firing can be at least about 1 hour, and particularly within a range between about 1 to 10 hours. After sufficiently heating the article to form a bonded abrasive article having abrasive grains contained within a vitreous bond material, the article can be cooled. Embodiments herein may utilize a natural and/or controlled cooling process.

The bonded abrasive articles of embodiments herein can include abrasive grains contained within a bond material, wherein the bond material is a vitreous material having an amorphous phase. It is noted that particular contents of certain compositions (e.g. alkaline oxide compounds, silica, alumina, boron oxide, etc), can change during the high temperature forming process such that the final-formed bonded abrasive article has a different content of such compositions as compared to the content of such compositions within the initial mixture. The bonded abrasive articles of embodiments herein are formed such that the final bond material of the abrasive article has certain contents of certain components, and particularly a content of alumina and particular ratios of certain components to facilitate forming the abrasive article.

We now refer to certain aspects of the vitreous bond material in the final-formed abrasive article. As will be appreciated, the bond material of the final-formed abrasive article can contain a significant amount of an amorphous phase, such that a majority of the bond material comprises an amorphous phase. In fact, substantially all of the bond material can contain an amorphous phase material such that the bond material consists essentially of an amorphous phase. Still, it will be appreciated that the bond material may contain some content of crystalline phase, however, the amount of such crystalline phases is generally a minority amount (i.e., less than about 50 vol % of the total volume of the abrasive article).

The vitreous bond material can have a certain content of silica. In accordance with one embodiment, the final-formed bond material can contain not greater than about 70 mol % silica of the total moles of material within the bond material. Other embodiments can contain a different amount of silica in the final vitreous bond material, such as not greater than about 65 mol %, such as not greater than about 60 mol %, not greater than about 55 mol %, or even not greater than about 50 mol %. Still, in certain embodiments, the bond material can have between about 30 mol % and about 70 mol % silica, between 35 mol % and about 65 mol % silica, between about 35 mol % and about 60 mol % silica, and even between about 40 mol % and about 50 mol % silica.

The final-formed bond material of embodiments herein can have a particular content of boron oxide. For example, the final-formed bond material can have at least about 5.0 mol % boron oxide of the total moles in the bond material. In other instances, the bond material can contain at least about 8.0 mol %, such as at 10 mol %, such as at least about 15 mol % boron oxide. In certain embodiments, the bond material has a content of boron oxide within a range between about 5.0 mol % and about 30 mol %, such as between about 10 mol % and about 25 mol %, or even between about 12 mol % and about 18 mol %.

The final-formed bond material can exhibit certain contents of alumina ($Al_2O_3$) suitable for forming the high-temperature bonded abrasive article of embodiments herein. For example, the total content of alumina within the vitreous bond material can be at least about 15 mol %, such as at least about 15.5 mol %, at least about 16 mol %, at least about 16.5 mol %, or even at least about 17 mol %. Certain abrasive articles can have a total content of alumina within the vitreous bond material within a range between about 15 mol % and about 25 mol %, such as between about 15.5 mol % and about 22 mol %, and about 16 mol % and about 20 mol %.

Notably, the vitreous bond material can have a particular ratio of alumina as compared to other species within the bond material, including for example, but not limited to silica. The vitreous bond material can have a ratio of a total content of alumina [$C_{Al2O3}$] in mol % as compared to a total content of silica [$C_{SiO2}$] in mol %, wherein the ratio of [$C_{Al2O3}$]/[$C_{SiO2}$] is at least about 0.2. In certain other embodiments, the ratio [$C_{Al2O3}$]/[$C_{SiO2}$] can be at least about 0.3, such as at least about 0.35, at least about 0.4, at least about 0.5, or even at least about 0.6. In particular instances, the ratio [$C_{Al2O3}$]/[$C_{SiO2}$] can be within a range between about 0.2 and about 1, such as between about 0.3 and about 0.9, between about 0.4 and about 0.8, between about 0.3 and about 0.7, and even between about 0.3 and about 0.6.

Moreover, the vitreous bond material can contain a particular ratio between the amount of alumina and the amount of boron oxide. For example, the vitreous bond material can have a ratio between the total content of alumina [$C_{Al2O3}$] in mol % and the total content of boron oxide [$C_{B2O3}$] in mol %, described as [$C_{Al2O3}$]/[$C_{B2O3}$] that can be within a range between about 0.2 and about 2. In other instances, the ratio [$C_{Al2O3}$]/[$CB_{2O3}$] can be within a range between about 0.5 and about 2, such as between about 0.5 and about 1.5, such as between about 0.8 and about 1.5, between about 0.8 and about 1.3, and even between about 0.9 and about 1.2.

According to certain embodiments herein, the vitreous bond material of the abrasive article can be formed of a particular composition to mitigate abrasive grain dissolution during forming processes. In particular, the vitreous bond material can be formed from a powder bond material having a sufficient amount of alumina to reduce the dissolution of abrasive grains into the bond material. The degree of dissolution can be measured by a change in total alumina content [$\Delta$ $Al_2O_3$] between the alumina content of the powder bond material [$PBM_{Al2O3}$] and the total alumina content of the vitreous bond material [$VBM_{Al2O3}$]. Certain abrasive articles according to embodiments herein can have a change in total alumina content of not greater than about 15.0 mol % as calculated by the equation [$\Delta$ $Al_2O_3$]=([$VBM_{Al2O3}$−$PBM_{Al2O3}$]/[$PBM_{Al2O3}$]. In other embodiments, the change in total alumina content can be less, such as not greater than about 12.0 mol %, not greater than about 10.0 mol %, not greater than about 8.0 mol %, not greater than about 6.0 mol %, not greater than about 5.0 mol %, not greater than about 3.0 mol %, or even not greater than about 1.0 mol %. According to at least one embodiment, the change in total alumina content is within a range between about 0.01 mol % and about 15.0 mol %, such as between about 0.5 mol % and about 12 mol %, between about 1.0 mol % and about 12 mol %, between about 1/0 mol % and about 10 mol %, and even between about 1.0 mol % and about 8.0 mol %.

The abrasive articles of embodiments herein can have a total content of alkali oxide compounds within the bond material. That is, the total amount of alkali oxide compounds [Caoc] within the final bond material can be not greater than about 15 mol %. In particular, the total content of alkali oxide compounds can be not greater than about 12 mol %, not greater than about 11 mol %, not greater than about 10 mol %, not greater than about 8.0 mol %, not greater than about 6.0 mol %, or even not greater than about 5.0 mol %. In certain instances, the abrasive articles herein are formed such that the bond material has a total content of alkali oxide compounds within a range between about 1.0 mol % and about 15 mol %, such as between about 1.0 mol % and about 15 mol %, between about 2.0 mol % and about 10 mol %, between about 2.0 mol % and about 8.0 mol %, or even between about 2.0 mol % and about 5.0 mol %.

As noted above, the initial mixture of the bond material powder used to form the final vitreous bond material can contain particular amounts of certain alkali oxide compounds such as sodium oxide. As such, the vitreous bond material of the abrasive article can have at least about 2.0 mol % sodium oxide. In other bond materials, the amount of sodium oxide can be at least about 5.0 mol %, at least about 6.0 mol %, at least about 8.0 mol %, and particularly within a range between about 2.0 mol % and about 20 mol %, between about 4.0 mol % and about 18 mol %, at least about 6.0 mol % and about 16 mol %, at least about 8.0 mol % and about 15 mol %. Notably, the amount of sodium oxide within the final vitreous bond material can be greater than the amount of any other alkali oxide compounds, such as potassium oxide or lithium oxide. In fact, certain vitreous bond materials can have an amount of sodium oxide that is greater than the total content of potassium oxide and lithium oxide combined.

The vitreous bond material can have an amount of potassium oxide present in a minor amount. For example, the vitreous bond material can include not greater than about 5.0 mol % potassium oxide, such as not greater than about 3.0 mol % potassium oxide, not greater than about 2.5 mol % potassium oxide, or even not greater than about 2.0 mol % potassium oxide. Certain embodiments may utilize an amount of potassium oxide within a range between about 0.01 mol % and about 5.0 mol %, such as between about 0.1 mol % and about 3.0 mol %. Notably, in some embodiments the final-formed bond material of the abrasive article can be essentially free of potassium oxide.

The vitreous bond material can have an amount of lithium oxide that is low, particularly lower than amounts of sodium oxide or potassium oxide. For example, the vitreous bond material can include not greater than about 5.0 mol % lithium oxide, such as not greater than about 3.0 mol % lithium oxide, not greater than about 2.5 mol % lithium oxide, or even not greater than about 2.0 mol % lithium oxide. Certain embodiments may utilize an amount of lithium oxide within a range between about 0.01 mol % and about 5.0 mol %, such as between about 0.1 mol % and about 3.0 mol %. Notably, in some embodiments the final-formed bond material of the abrasive article can be essentially free of lithium oxide.

Moreover, the vitreous bond material can contain a particular ratio between the amount of alumina and the total amount of alkali oxide compounds. For example, the vitreous bond material can have a ratio between the total content of alumina [$C_{Al2O3}$] in mol % and the total content of alkali oxide compounds [Caoc] in mol %, described as [$C_{Al2O3}$]/[Caoc] that can be at least about 0.8. In other embodiments, the value of the ratio can be greater, such as at least about 0.85, at least about 0.9, at least about 1.0, at least about 1.05, or even at least about 1.1. Particular embodiments can utilize a ratio having a value within a range between about 0.8 and about 2.5, such as between about 0.8 and about 2.2, between about 0.8 and about 2.0, between about 0.9 and about 1.8, between about 0.8 and about 1.5, between about 0.9 and about 1.4, between about 0.95 and about 1.35, between about 1.0 and about 1.3, or even between about 1.1 and about 1.25.

Additionally, the final-formed bond material may contain a certain content of alkaline earth oxide compounds [Caeoc]. In particular instances, the abrasive article can be formed such that the vitreous bond material can contain not greater than about 15 mol %, such as not greater than about 12 mol %, not greater than about 10 mol %, not greater than about 8.0 mol %, not greater than about 5.0 mol %, or even not greater than about 3.0 mol % alkaline earth oxide compounds. According to certain embodiments, the bond material can have a total content of alkaline earth oxide compounds between about 0.5 mol % and about 15 mol %, between about 1.0 mol % and about 10 mol %, between about 1.0 mol % and about 8.0 mol %, and even between about 1.0 mol % and about 5.0 mol % alkaline earth oxide compounds.

The vitreous bond material may contain specific amounts of alkaline earth oxide compounds. For example the vitreous bond material can contain a greater content of magnesium oxide than the content of barium oxide. In fact, the content of magnesium oxide within the vitreous bond material can be greater than the content of calcium oxide. More particularly, the content of magnesium oxide can be greater than the content of barium oxide and calcium oxide combined. Particular vitreous bond materials can contain an amount of magnesium oxide within a range between about 0.2 mol % and about 5.0 mol %, such as between about 0.5 mol % and about 3.0 mol %, and even between about 0.5 mol % and about 2.0 mol %. Certain vitreous bond materials may be essentially free of calcium oxide and/or barium oxide.

The bond may contain minor amounts of other materials, particularly oxide compounds, such as phosphorous oxide. For example, the final-formed bond material can have less than about 1.0 mol % of phosphorous oxide, such as less than about 0.5 mol % phosphorous oxide. In particular, the final-formed bond material of the abrasive article can be essentially free of phosphorous oxide.

The abrasive articles according to embodiments herein can contain a total abrasive grain content of at least about 34 vol % of the total volume of the abrasive body. For example, the abrasive grain content within the abrasive body can be at least about 38 vol %, at least about 40 vol %, at least about 42 vol %, at least about 44 vol %, at least about 46 vol %, or even at least about 50 vol %. In particular instances, the abrasive grain content can be within a range between about 34 vol % to about 60 vol %, such as between about 34 vol % and about 56 vol %, between about 40 vol % and about 54 vol %, and particularly between about 44 vol % and about 52 vol % of the total volume of the abrasive article. The MCA abrasive can account for between about 1 to about 100 vol % of the total abrasive grains of the abrasive article, such as between about 10 vol % and about 80 vol %, or between 30 vol % and about 70 vol % of the total volume of abrasive grains in the abrasive article. Moreover, some abrasive articles can include 0.1 vol % to 60 vol % of one or more secondary abrasive grains, fillers and/or additives.

The abrasive articles of the embodiments herein can include at least about 4 vol % vitreous bond material for the total volume of the abrasive body. In particular instances, the abrasive body can contain at least about 5 vol % bond, at least about 6 vol % bond, at least about 7 vol % bond, or even at least about 8 vol % bond. In certain abrasive articles, the abrasive body can contain between about 4 vol % and about 30 vol % bond material, such as between about 4 vol % and about 25 vol % bond, between about 5 vol % and about 20 vol % bond, and even between about 6 vol % to about 12 vol % bond.

While a majority of the abrasive tools can have various degrees of porosity, some of the abrasive bodies formed according to embodiments herein may exhibit a certain content of porosity. For example, the abrasive body can have a porosity that is at least about 30 vol % of the total volume of the abrasive article. In other instances, the porosity can be greater, such as at least about 35 vol %, at least about 40 vol %, or even at least about 45 vol %. Particular abrasive articles can have a content of porosity within a range between about 30 vol % and about 50 vol %, such as between about 30 vol % and about 45 vol %, and more particularly between about 35 vol % and about 45 vol %.

The abrasive articles of the embodiments herein demonstrate suitable levels of abrasive grain integrity, as measured by the attack of the bond material on the abrasive grains during a forming process. Abrasive articles formed according to embodiments herein were studied for abrasive grain dissolution, which was measured on samples of approximately 48 vol % abrasive grains of microcrystalline alumina, approximately 10 vol % bond material, and approximately 42 vol % porosity. The abrasive grain dissolution was recalculated based on the difference between the initial and the final alumina content of the bond. The final bond composition was measured by microprobe analysis using an SX50 machine available from CAMECA Corporation. An average of at least 10 analytical points in the bond with a spot size of 10 microns was used for each of the measurements, which was then averaged for each sample.

The abrasive articles of embodiments herein demonstrated a grain dissolution factor, as measured according to the test conditions provided above, of not greater than about 1.5 wt %. Some abrasive articles of the embodiments herein demonstrated a grain dissolution factor of not greater than about 1.2 wt %, not greater than about 1.1 wt %, not greater than about 1.0 wt %, about 0.9 wt %, such as not greater than about 0.8 wt %, not greater than about 0.7 wt %, not greater than about 0.5 wt %, or even not greater than about 0.4 wt %. Still, certain embodiments demonstrate a grain dissolution factor within a range between about 0.01 wt % and about 1.5 wt %, such as between about 0.01 wt % and about 1.3 wt %, between about 0.01 wt % and about 1.2 wt %, between about 0.01 wt % and about 1.1 wt %, between about 0.01 wt % and about 1.0 wt %, between about 0.01 wt % and about 0.9 wt %, between about 0.05 wt % and about 0.8 wt %, or even between about 0.1 wt % and about 0.8 wt %.

EXAMPLES

Example 1

A series of samples were prepared, including 5 samples (Samples S1, S2, S3, S4 and S5) formed according to embodiments herein and 5 conventional samples (Samples CS1, CS2, CS3, and CS4) having a conventional bond. The grain dissolution factor was tested for each of the samples and is set forth below.

The samples S1-S5 were formed by initially combining 80-90 wt % of abrasive grains with 9-15 wt % of an initial bond material having the amounts of alumina indicated in Table 1 below. The samples S1-S5 were initially cold pressed to form a green article, and thereafter sintered at a firing temperature of about 950° C., 1000° C. or 1050° C. to form a final bonded abrasive article having approximately 46-50 vol % abrasive grains, 7-12 vol % vitreous bond material, and a reminder amount of porosity. The final content of alumina within the bond material was measured via microprobe analysis using an SX50 machine available from CAMECA Corporation.

The conventional samples CS1-CS4 were formed according to the same processes of samples S1-S5, and the initial alumina content within the bond for each of the conventional samples is provided in Table 1 below. The final content of alumina within the bond material was measured via microprobe analysis using an SX50 machine available from CAMECA Corporation.

After forming all of the samples the grains dissolution factor was measured for each sample based on the equations provided below, wherein each of the variables (e.g., mGi) are indicated in Table 1. It should be noted that for the calculation, it is assumed that all the alumina enrichment comes from alumina grain dissolution. The amount of alumina enrichment is then recalculated as grain loss in wt %, taking into account the density of the alumina grain, and the density of the initial bond, which was measured via helium pycnometry.

$$mGi = 100 \times \frac{vGi \times dG}{vGi \times dG + vBi \times dBi}$$

$$mBi = 100 - mGi$$

$$mGdis = \frac{mBi \times (FmABf - FmABi)}{FmAG - FmABf}$$

$$X = 100 \times \frac{mGdis}{mGi}$$

As illustrated by the data of Table 1 below, each of the samples S1-S5 had a grain dissolution factor, as demonstrated by the value of the alumina grain loss in weight percent that is significantly less than the grain dissolution factor of the conventional samples CS1-CS4. Each of the samples S1-S5 demonstrated a greater content of initial alumina and a change in alumina content between the initial alumina content and the final alumina content that was significantly less than the conventional samples CS1-CS4. While the mechanism is not fully understood, the data suggests that certain contents of alumina within the initial bond material may limit grain dissolution. Moreover, without wishing to be tied to a particular theory, it is suspected that other factors may contribute to limiting the grain dissolution, including for example, the content of certain compounds, such as boron oxide, alkali oxide compounds, alkaline earth oxide compounds, and the like.

TABLE 1

| | | Conventional Samples | | | | Samples of the Embodiments | | | | |
|---|---|---|---|---|---|---|---|---|---|---|
| | | CS1 | CS2 | CS3 | CS4 | S1 | S2 | S3 | S4 | S5 |
| DATA INPUT | | | | | | | | | | |
| Firing temp. (° C.) | | 1050 | 1050 | 1050 | 950 | 1050 | 1000 | 1050 | 1000 | 1000 |
| Grain density (g/cc) | dG | 3.98 | 3.98 | 3.98 | 3.98 | 3.98 | 3.98 | 3.98 | 3.98 | 3.98 |
| Bond density initial (g/cc) | dBi | 2.505 | 2.455 | 2.467 | 2.39 | 2.455 | 2.511 | 2.547 | 2.395 | 2.347 |
| Grain content (vol %) | vGi | 48.00 | 48.00 | 48.00 | 48.00 | 48.00 | 48.00 | 48.00 | 48.00 | 48.00 |
| Bond content (vol %) | vBi | 10.26 | 10.26 | 10.26 | 10.26 | 10.26 | 10.26 | 10.26 | 10.26 | 10.26 |
| Porosity content (vol %) | vPi | 41.74 | 41.74 | 41.74 | 41.74 | 41.74 | 41.74 | 41.74 | 41.74 | 41.74 |
| Al2O3 content in grain (wt %) | FmAG | 96.96 | 96.96 | 96.96 | 96.96 | 96.96 | 96.96 | 96.96 | 96.96 | 96.96 |

TABLE 1-continued

| | | Conventional Samples | | | | Samples of the Embodiments | | | | |
|---|---|---|---|---|---|---|---|---|---|---|
| | | CS1 | CS2 | CS3 | CS4 | S1 | S2 | S3 | S4 | S5 |
| $Al_2O_3$ content in initial bond (wt %) | FmABi | 0.20 | 0.40 | 16.00 | 16.05 | 20.00 | 25.50 | 24.80 | 26.90 | 26.10 |
| $Al_2O_3$ content in final bond (wt %) | FmABf | 27.10 | 22.40 | 27.10 | 25.50 | 24.80 | 28.60 | 27.10 | 28.70 | 26.40 |
| DATA OUTPUT | | | | | | | | | | |
| Grain content (wt %) | mGi | 88.14 | 88.35 | 88.30 | 88.62 | 88.35 | 88.12 | 87.97 | 88.60 | 88.81 |
| Bond content (wt %) | mBi | 11.86 | 11.65 | 11.70 | 11.38 | 11.65 | 11.88 | 12.03 | 11.31 | 11.19 |
| Alumina Grain dissolution (g) | mGdis | 4.57 | 3.44 | 1.86 | 1.50 | 0.77 | 0.54 | 0.40 | 0.30 | 0.05 |
| Alumina grain loss (wt %) | X | 5.18 | 3.89 | 2.11 | 1.70 | 0.88 | 0.61 | 0.45 | 0.34 | 0.05 |

Example 2

Two samples are formed. Sample S6 is formed according to the embodiments herein. Sample CS5 is a conventional sample having the same characteristics of Sample CS1 of Example 1. Notably, samples S6 and CS5 have the same structure as samples of Example 1, however, the samples are fired at 915° C.

Sample S6 has a starting alumina weight percent of 26.94 wt % (18.59 mol %) and a final alumina content of 28.7 wt % (19.25 mol %), thus demonstrating an alumina grain dissolution of 0.33 wt % as measured according to the methods disclosed herein. Sample CS5 has a starting alumina content of 16.05 wt % (10.13 mol %), a final alumina content of 25.5 wt % (17.02 mol %), and thus an alumina grain dissolution of 1.70 wt %, as measured according to the formula and methods described herein. As such, sample S6 demonstrates significantly less alumina grain dissolution during the forming process.

The samples S6 and CS5 were subject to an internal diameter grinding operation to determine the power consumption of the bonded abrasive articles per grinding cycle and also the straightness of the samples S6 and CS5 after the grinding procedure. The grinding conditions are summarized in Table 2 below.

TABLE 2

| Parameters | Values |
|---|---|
| Work material type | 52100 bearing steel |
| Wheel speed (rpm) | 1250 |
| Work speed (m/sec) | 52 |
| Total material removed (m) | ~200 |
| Constant feed grinding mode Air, Rough 1, Rough 2, Fine (m/sec) | 300, 75, 60, 15 |
| Grind Width (mm) | ~14 mm |
| Dressing Depth ((m) | 10 |
| Dress Frequency | After 10 grinds |

Figure 2:
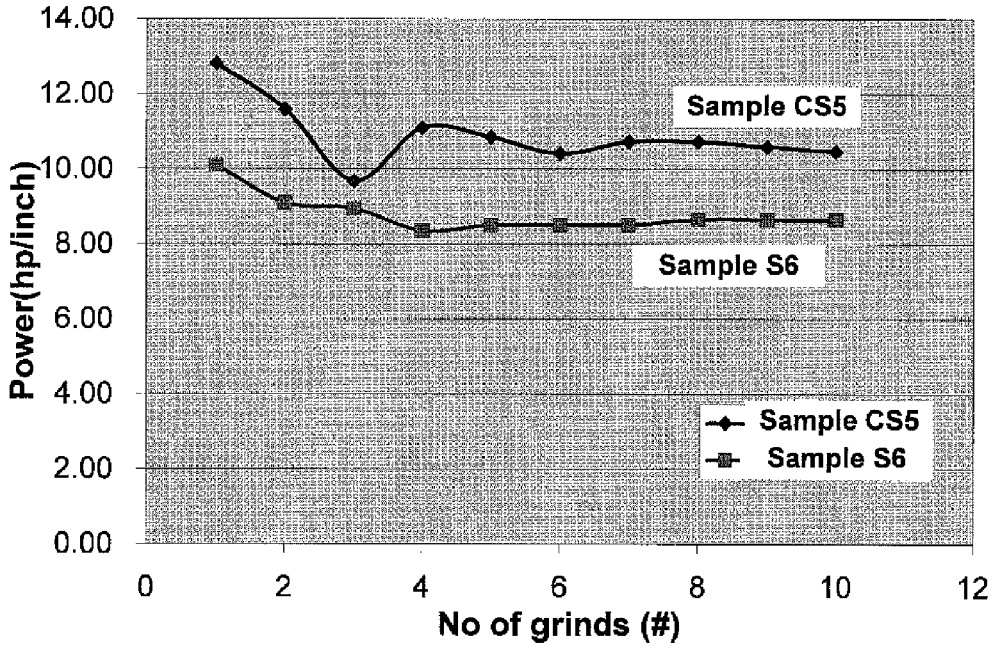
FIG. 2 includes a plot of power consumption versus number of grinding cycles for a sample formed according to an embodiment and a conventional sample.
Figure 3:
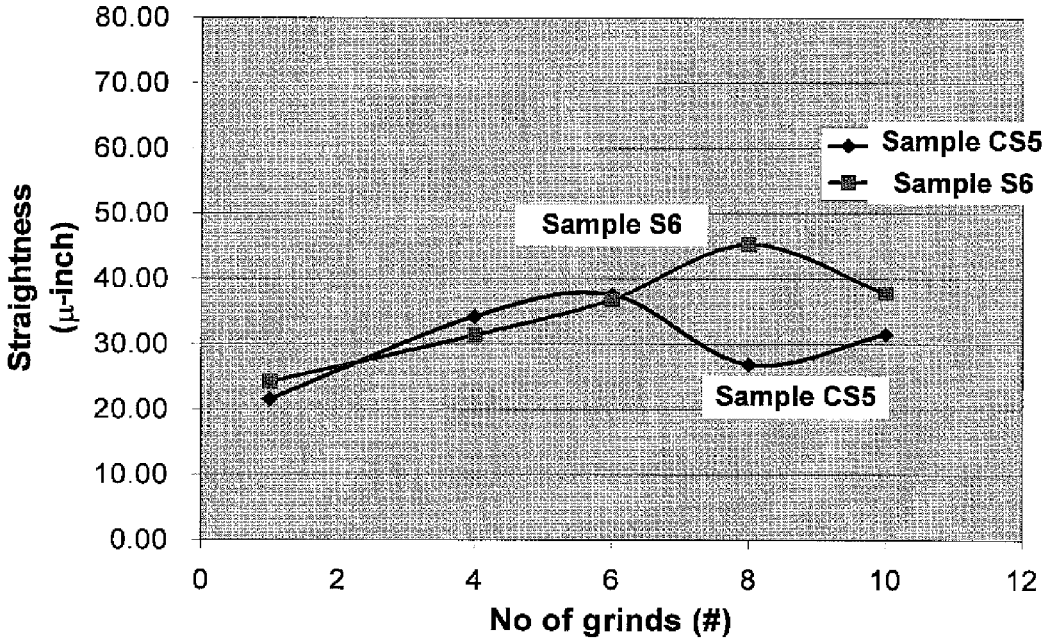
FIG. 3 includes a plot of straightness versus number of grinding cycles for a sample formed according to an embodiment and a conventional sample.

FIGS. 2 and 3 summarize the test results. FIG. 2 includes a plot of power versus number of grinding cycles for each of the samples (i.e., S6 and CS5). The data of FIG. 3 demonstrates that the sample S6 utilizes less power for all grinding cycles, and thus a lower average power consumption for each of the grinding cycles, suggesting that sample S6 has improved abrasive grain integrity as compared to sample CS5.

Additionally, FIG. 3 includes a plot of straightness versus number of grinding cycles, which is a measure of the linearity of the surface generated in the workpiece after the grinding operation by the bonded abrasive article. The straightness of the part generated can be related to the uniformity of wheel wear in the edges and the bulk regions. Straightness measurements are performed with the help of a round gage (Formscan 260 from Mahr Federal) and line profiles are generated along the surface of the workpiece. Four such measurements are made on each part and their average is reported as the value of straightness. This test method is according to the standard ASME Y14.5M "Dimensioning and Tolerancing." As illustrated, the sample S6 demonstrates approximately the same degree of variation in the straightness as compared to sample CS5. As such, in conjunction with the data of FIG. 2, sample S6 is capable of delivering the same quality grinding performance while using less power, thus providing a more efficient grinding process as compared to sample CS5.

The embodiments herein are directed to abrasive articles incorporating microcrystalline alumina grains in a high temperature bonded abrasive article, wherein the microcrystalline alumina grains exhibit improved integrity and minimized dissolution and degradation. Generally, the state-of-the-art bonded abrasive articles employing MCA grains have been directed to the formation and use of low temperature vitrified bonds formed at temperatures below 1000° C. However, the embodiments herein are directed to a bonded abrasive article formed to include certain contents (e.g., ratio) of materials within the bond material powder, to form vitreous bond compositions capable of being formed at high temperatures while mitigating the degradation and/or dissolution of the abrasive grains comprising MCA during forming. The embodiments herein can utilize one or more combinations of features, including particular bond compositions, particular ratios of compounds within the bond, including but not limited to, a ratio between the alumina and silica, a ratio between the alumina and boron oxide, a ratio between the alumina and alkali oxide compounds, as well as ratios between other components including boron oxide, alkaline earth oxides, alkali oxide compounds, and the like. The foregoing describes a combination of features, which can be combined in various manners to describe and define the bonded abrasive articles of the embodiments. The description is not intended to set forth a hierarchy of features, but different features that can be combined in one or more manners to define the invention.

In the foregoing, reference to specific embodiments and the connections of certain components is illustrative. It will be appreciated that reference to components as being coupled or connected is intended to disclose either direct connection between said components or indirect connection through one or more intervening components as will be appreciated to carry out the methods as discussed herein. As such, the above-disclosed subject matter is to be considered illustrative, and not restrictive, and the appended claims are intended to cover all such modifications, enhancements, and other embodiments, which fall within the true scope of the present invention. Thus, to the maximum extent allowed by law, the scope of the present invention is to be determined by the broadest permissible interpretation of the following claims and their equivalents, and shall not be restricted or limited by the foregoing detailed description.

The Abstract of the Disclosure is submitted with the understanding that it will not be used to interpret or limit the scope or meaning of the claims. In addition, in the foregoing Detailed Description, various features may be grouped together or described in a single embodiment for the purpose of streamlining the disclosure. This disclosure is not to be interpreted as reflecting an intention that the claimed embodiments require more features than are expressly recited in each claim. Rather, as the following claims reflect, inventive subject matter may be directed to less than all features of any of the disclosed embodiments. Thus, the following claims are incorporated into the Detailed Description, with each claim standing on its own as defining separately claimed subject matter.

What is claimed is:

1. An abrasive article comprising:

an abrasive body having abrasive grains comprising microcrystalline alumina contained within a vitreous bond material, wherein the vitreous bond material comprises a total content of alumina [$C_{Al2O3}$] of greater than 18 mol %, a total content of boron oxide [$C_{B2O3}$] of at least about 5.0 mol %, a total content of silica [$C_{SiO2}$] of not greater than about 70 mol %, and a total content of alkali oxide compounds [$C_{aoc}$] selected from the group of alkali compounds consisting of potassium oxide ($K_2O$), sodium oxide ($Na_2O$), and lithium oxide ($Li_2O$) is not greater than about 15 mol %.

2. The abrasive article of claim 1, wherein the total content of silica is not greater than about 65 mol %.

3. The abrasive article of claim 1, wherein the total content of alkali oxide compounds is not greater than about 12 mol %.

4. The abrasive article of claim 1, wherein the total content of alkali oxide compounds is within a range between about 1.0 mol % and about 15 mol %.

5. The abrasive article of claim 1, wherein the content of sodium oxide is greater than the total content of potassium oxide and lithium oxide combined.

6. The abrasive article of claim 1, wherein the vitreous bond material comprises a ratio between the total content of alumina [$C_{Al2O3}$] and the total content of boron oxide [$C_{B2O3}$], described as [$C_{Al2O3}$]/[$C_{B2O3}$] within a range between about 0.2 and about 2.

7. The abrasive article of claim 1, wherein the vitreous bond material comprises an alkaline earth oxide material selected from the group consisting of calcium oxide (CaO), barium oxide (BaO), magnesium oxide (MgO), and a combination thereof.

8. The abrasive article of claim 5, wherein the total content of potassium oxide is less than a total content of any one of a total content of lithium oxide and a total content of sodium oxide.

9. The abrasive article of claim 5, wherein the total content of potassium oxide is not greater than about 5.0 mol %.

10. The abrasive article of claim 7, wherein the vitreous bond material comprises a total content of alkaline earth oxide material of not greater than about 15 mol %.

11. The abrasive article of claim 7, wherein the vitreous bond material comprises a greater content of magnesium oxide than a content of barium oxide.

12. The abrasive article of claim 7, wherein the vitreous bond material comprises a greater content of magnesium oxide than a content of calcium oxide.

13. The abrasive article of claim 7, wherein the vitreous bond material comprises a greater content of magnesium oxide than a total content of barium oxide and calcium oxide combined.

14. The abrasive article of claim 1 wherein the vitreous bond material comprises a grain dissolution factor of not greater than about 1.5 wt %.

15. The abrasive article of claim 1, wherein the vitreous bond material is essentially free of phosphorous oxide ($P_2O_5$).

16. The abrasive article of claim 1, wherein the abrasive body comprises at least about 30 vol % porosity.

17. The abrasive article of claim 1, wherein the vitreous bond material comprises an amorphous phase.

18. The abrasive article of claim 17, wherein the vitreous bond material consist essentially of an amorphous phase.

19. The abrasive article of claim 1, wherein the abrasive grains consist essentially of microcrystalline alumina.

20. The abrasive article of claim 1, wherein the microcrystalline alumina comprises crystallites having an average crystallite size of less than about 1 micron.

* * * * *

UNITED STATES PATENT AND TRADEMARK OFFICE

CERTIFICATE OF CORRECTION

PATENT NO. : 8,721,751 B2
APPLICATION NO. : 12/959282
DATED : May 13, 2014
INVENTOR(S) : Gilles Querel et al.

It is certified that error appears in the above-identified patent and that said Letters Patent is hereby corrected as shown below:

Specification

Column 15, TABLE 2, please delete "Total material removed (m)" and insert therefor -- Total material removed (μm) --

Column 15, TABLE 2, please delete "Constant feed grinding mode Air, Rough 1, Rough 2, Fine (m/sec)" and insert therefor -- Constant feed grinding mode Air, Rough 1, Rough 2, Fine (μm/sec) --

Column 15, TABLE 2, please delete "Dressing Depth (m)" and insert therefor -- Dressing Depth (μm) --

Signed and Sealed this
Twenty-third Day of February, 2016

Michelle K. Lee

Michelle K. Lee
*Director of the United States Patent and Trademark Office*